United States Patent [19]

Campbell et al.

[11] 3,960,679

[45] June 1, 1976

[54] PROCESS FOR HYDRODIMERIZING OLEFINIC COMPOUNDS

[75] Inventors: Charles R. Campbell; Donald E. Danly, both of Pensacola, Fla.; Werner H. Mueller, Kelkheim Hornau, Taunus, Germany

[73] Assignee: Monsanto Company, St. Louis, Mo.

[22] Filed: June 27, 1975

[21] Appl. No.: 591,181

Related U.S. Application Data

[63] Continuation of Ser. No. 497,807, Aug. 15, 1974, abandoned, which is a continuation-in-part of Ser. No. 284,373, Aug. 28, 1972, Pat. No. 3,830,712.

[52] U.S. Cl. ..... 204/73 A; 204/73 R

[51] Int. Cl.[2] ..... C25B 3/10; C07C 121/26; C07C 103/147; C07C 69/34

[58] Field of Search ..... 204/72, 73 R, 73 A

[56] References Cited

UNITED STATES PATENTS

| | | | |
|---|---|---|---|
| 3,511,765 | 5/1970 | Beck et al. | 204/73 A |
| 3,689,382 | 9/1972 | Fox et al. | 204/73 A |
| 3,830,712 | 8/1974 | Campbell et al. | 204/73 A |

*Primary Examiner*—F. C. Edmundson

[57] ABSTRACT

In a process for hydrodimerizing an olefinic nitrile, amide or ester by electrolyzing an aqueous solution of the olefinic compound, alkali metal salt and quaternary ammonium or phosphonium cations, the selectivity with which the hydrodimer is produced is surprisingly high when the solution contains less than about 5% by weight of the olefinic compound and alkali metal cations constituting more than half of the total weight of all cations in the solution and the solution is electrolyzed in contact with a cathode consisting essentially of cadmium.

15 Claims, No Drawings

PROCESS FOR HYDRODIMERIZING OLEFINIC COMPOUNDS

CROSS-REFERENCE TO RELATED APPLICATION

This is a continuation of application Ser. No. 497,807 filed Aug. 15, 1974 now abandoned which is a continuation-in-part of application Ser. No. 284,373, filed Aug. 28, 1972, now U.S. Pat. No. 3,830,712.

BACKGROUND OF THE INVENTION

Production of paraffinic dinitriles, dicarboxamides or dicarboxylates by electrolytic hydrodimerization of an alpha, beta-olefinic nitrile, carboxamide or carboxylate is well known, e.g. from U.S. Pat. Nos. 3,193,475-79 and 3,193,481-83 issued July 6, 1965, to M. M. Baizer. Although the process has been sufficiently attractive that it has been in commercial use for over 9 years, efforts to develop improvements thereon have been continued with particular emphasis on lowering electric power costs and mitigatng electrode corrosion and fouling tendencies because of which it has been heretofore commercially preferable to carry out the process with a cell-dividing membrane. With the object of maintaining high electrolyte conductivity while employing a relatively low proportion of organic salts in the electrolysis medium, one approach to improvement of the process has been to carry out the electrolysis in an aqueous solution of a mixture of quaternary ammonium and alkali metal salts together with the olefinic compound to be hydrodimerized.

An example of a process utilizing such an approach is described in Netherlands Patent Application 66, 10378 which was laid open for public inspection Jan. 24, 1967. As described in that application, adiponitrile is produced by electrolyzing a neutral aqueous solution of acrylonitrile, an alkali metal salt of a polyvalent acid such as phosphoric, boric or sulfuric and a small quantity of a quaternary ammonium salt. According to the examples of that application, good selectivities can be achieved when such a process is carried out in an undivided (membraneless) cell having a graphite cathode. Further development of the process, also with use of a graphite cathode, is described in U.S. Pat. No. 3,616,321 issued Oct. 26, 1971, to A. Verheyden et al. As is known in the art, however, commercial-scale use of graphite cathodes in a process of the type discussed herein is not very attractive, primarily because graphite is quite brittle and, at the desirably-elevated hydrodimerization temperatures and generally-optimum electrolyte flow rates of at least about 0.3 meter per second, sufficiently subject to erosion and/or fouling that it soon becomes roughened and the selectivity of the reaction (which takes place at the cathode) drops sharply.

superficially, it might have seemed that various other materials having high hydrogen overvoltages could be satisfactorily substituted for graphite as the cathode in electrolytic hydrodimerization (EHD) processes similar to that of Netherlands Application No. 66,10378 and U.S. Pat. No. 3,616,321 and, in fact, the suitability of a variety of such other materials for use in certain EHD processes has been suggested in the aforecited U.S. Pat. Nos. 3,193,375-79 and 3,193,481-83, in U.S. Pat. No. 3,511,765 issued May 12, 1970, to Fritz Beck et al. in U.S. Pat. No. 3,595,764 issued July 27, 1971, to Maomi Seko et al. and in U.S. Pat. No. 3,689,382 issued Sept. 5, 1972, to H. N. Fox et al. However, and notwithstanding those suggestions, it has been recognized in the art that at least in some instances when an olefinic compound EHD medium contains significant amounts of alkali metal salts, the selectivity with which the desired hydrodimer is produced is highly dependent on the specific cathode material employed. To illustrate, in British Pat. No. 1,014,428 issued Dec. 22, 1965, to Ivan L. Knounjants et al., the patentees demonstrated that the hydrodimer selectivity in electrolytic hydrodimerization of an olefinic compound such as acrylonitrile is quite high (70–80%) when a graphite cathode is employed with a low-temperature (below 0°C.) aqueous electrolyte containing alkali metal ions in substantial concentration (0.7 to 1.2N) but that with the same electrolyte, an iron cathode yielded only about 20% of the dinitrile (based on the converted monomer) and a cadmium cathode provided practically no reaction product other than the saturated monomer (propionitrile). High ratios of propionitrile to adiponitrile obtained when various cathode materials other than graphite are employed with an electrolyte containing alkali metal ions are also demonstrated and an explanation is provided by Baizer in Journal of the Electrochemical Society, Vol. 111, No. 2, at pages 215–22 (1964).

For reasons including those set forth hereinbefore, a process by which an olefinic nitrile, carboxamide or carboxylate can be electrolytically hydrodimerized with high selectivity while using as the electrolysis medium an aqueous solution containing an alkali metal salt in significant amount and in which the cathode is dimensionally stable and resistant to corrosion for long periods of time is highly attractive for commercial use. Accordingly, the provision of such a process is a primary object of the invention described herein. Another object of this invention is to provide such a process which can be satisfactorily carried out in an electrolytic cell in which the anode is in contact with the electrolysis medium and subject to corrosion under those conditions. Further objects of the invention will be apparent from the following description and Examples in which all percentages are by weight except where otherwise noted.

SUMMARY OF THE INVENTION

It has now been discovered that an olefinic compound having the formula $R_2C{=}CR{-}X$ wherein $-X$ is $-CN$, $-CONR_2$ or $-COOR'$, R is hydrogen or R', and R' is $C_1$–$C_4$ alkyl can be hydrodimerized to prepare a hydrodimer having the formula $X{-}CHR{-}CR_2{-}CR_2{-}CHR{-}X$ wherein X and R have the aforesaid significance with a high molar selectivity (generally at least about 75% and in many cases at least about 80%) based on the converted olefinic compound by electrolyzing an aqueous solution of the olefinic compound, quaternary ammonium or phosphonium cations and an alkali metal salt in contact with a cathodic surface consisting essentially of cadmium. In one embodiment of the invention, the aqueous solution has dissolved therein at least about 0.1% of the olefinic compound, quaternary ammonium or phosphonium cations in a concentration of at least about $10^{-5}$ gram mol per liter and at least about 1% of alkali metal salt sufficient to provide alkali metal cations constituting more than half of the total weight of all cations in the solution. In another embodiment of the invention, the aqueous solution has dissolved therein at least about 0.1% of the alkali metal salt, quaternary ammonium or phosphonium cations in a concentration of at least about $10^{-5}$ gram mol per liter and at least about 0.1% but less than about 5% of the olefinic compound. In still another embodiment of the invention, the aqueous solution has dissolved therein at least about 0.1% of the olefinic compound, quaternary ammonium or phosphonium cations in a concentration of at least about $10^{-5}$ gram mol per liter and at least about 5% of the alkali metal salt. As disclosed in greater detail hereinafter, the quaternary ammonium or phosphonium cations employed in some embodiments of the invention are monovalent monoquaternary ammonium (e.g. tetraalkylammonium) or monoquaternary phosphonium (e.g. tetraalkylphosphonium) cations while in other embodiments the quaternary ammonium or phosphonium cations are multivalent ions such as bis-quaternary ammonium or phosphonium cations, e.g. polymethylenebis(trialkylammonium or trialkylphosphonium) cations, or a mixture of such monovalent and multivalent cations. Even when the process is carried out in an electrolytic cell in which the anode is in contact with the aqueous solution, fouling of the cathode proceeds very slowly and the hydrodimer selectivity remains high for an exceptionally long time, particularly when the cathodic surface has a centerline average not greater than about 90 microinches. Each of the embodiments of the invention is particularly useful in the preparation of adiponitrile, a nylon 66 intermediate, by the hydrodimerization of acrylonitrile.

DETAILED DESCRIPTION OF THE INVENTION

Olefinic compounds that can be hydrodimerized by the process of this invention include those having the structural formula $R_2C{=}CR{-}X$ wherein —X is —CN, $-CONR_2$ or —COOR′, R is hydrogen or R′ and R′ is $C_1$–$C_4$ alkyl (i.e., methyl, ethyl, n-propyl, isopropyl, n-butyl, isobutyl or tert-butyl). Compounds having that formula are known as having alpha, beta mono-unsaturation and in each such compound, at least one R may be R′ while at least one other R is hydrogen and at least one R′, if present, may be an alkyl group containing a given number of carbon atoms while at least one other R′, if present, is an alkyl group containing a different number of carbon atoms. Such compounds include olefinic nitriles such as, for example, acrylonitrile, methacrylonitrile, crotononitrile, 2-methylenebutyronitrile, 2-pentenenitrile, 2-methylenevaleronitrile, 2-methylenehexanenitrile, tiglonitrile or 2-ethylidenehexanenitrile; olefinic carboxylates such as, for example, methyl acrylate, ethyl acrylate or ethyl crotonate; and olefinic carboxamides such as, for example, acrylamide, methacrylamide, N,N-diethylacrylamide or N,N-diethylcrotonamide. Best results are generally obtained when the olefinic compound has at least one hydrogen atom directly attached to either of the two carbon atoms joined by the double bond in the aforedescribed structural formula. Also presently of greater utility in the process of this invention are those olefinic compounds wherein R′ in that formula is methyl or ethyl, and particularly acrylonitrile and alpha-methyl acrylonitrile. Products of hydrodimerization of such compounds have the structural formula $X{-}CHR{-}CR_2{-}CR_2{-}CHR{-}X$ wherein X and R have the aforesaid significance, i.e. paraffinic dinitriles such as, for example, adiponitrile and 2,5-dimethyladiponitrile; paraffinic dicarboxylates such as, for example, dimethyladipate and diethyl-3,4-dimethyladipate; and paraffinic dicarboxamides such as, for example, adipamide, dimethyladipamide and N,N′-dimethyl-2,5-dimethyladipamide. Such hydrodimers can be employed as monomers or as intermediates convertible by known processes into monomers useful in the manufacture of high molecular weight polymers including polyamides and polyesters. The dinitriles, for example, can be hydrogenated by known processes to prepare paraffinic diamines especially useful in the production of high molecular weight polyamides. Other examples of various olefinic compounds that can be hydrodimerized by the process of this invention and the hydrodimers thereby produced are identified in the aforecited U.S. Pat. Nos. 3,193,475-79 and 3,193,481-83.

The invention is herein described in terms of electrolyzing an aqueous solution having dissolved therein certain proportions of the olefinic compound to be hydrodimerized, quaternary ammonium or phosphonium cations and an alkali metal salt. Use of the term "aqueous solution" does not imply, however, that the solution may not also contain a dispersed but undissolved organic phase. To the contrary, the process of this invention can be quite satisfactorily carried out with the recited aqueous solution containing anywhere from a very small to a very substantial proportion of an undissolved organic phase during electrolysis of the solution. Hence in some embodiments of the invention there may be suitably electrolyzed an aqueous solution containing essentially no undissolved organic phase, by which is meant that the solution may contain either no measurable amount of undissolved organic phase or a minute proportion of undissolved organic phase such as might remain entrained in the aqueous solution despite the latter being permitted to stand without agitation after electrolysis and cooling and/or addition of more of the olefinic starting material to faciliate separation of a product-containing organic phase, but the presence of which has no significant effect on the olefinic compound conversion per pass or hydrodimer selectivity achieved when the separated aqueous phase is recycled for further electrolysis in accordance with the process of this invention. Such a minute proportion, if present, would be typically less than 5% of the combined weight of the aqueous solution and the undissolved organic phase contained therein. In other embodiments, the invention can be carried out by electrolyzing an aqueous solution of the type described hereinbefore but having dispersed therein an undissolved organic phase in a larger proportion (e.g. up to 15%, 20% or even more of the combined weight of the aqueous solution and the undissolved organic phase contained therein) which may or may not significantly affect the conversion per pass or hydrodimer selectivity depending on other conditions of the process. In some continuous process embodiments involving recycle of unconverted olefinic compound and whether present in a minute or larger proportion, such an organic phase is normally made up mainly (most commonly at least about 65% and even more typically at least about 75%) of the olefinic compound to be hydrodimerized and the hydrodimer product with some minor amounts of organic hydrodimerization by-products, quaternary ammonium or phosphonium cations, etc. posibly also present. In any event, however, the concentrations of the constituents dissolved in the aqueous solution to be electrolyzed, as set forth in this specification and the appended claims, are with reference to the recited aqueous solution alone and not the combined contents of said aqueous solution and an undissolved organic phase which, as aforesaid, may be present but need not be present in the aqueous solution as the invention is carried out. On the other hand, the weight percentages of undissolved organic phase in the aqueous solutions described herein are based on the combined weight of the aqueous solution and the undissolved organic phase contained therein.

Referring to the constituents of the aqueous phase, the olefinic compound to be hydrodimerized will be present in at least such a proportion that electrolysis of the solution, as described herein, will result in a substantial amount of the desired hydrodimer being produced. That proportion is generally at least about 0.1% of the aqueous solution, more typically at least about 0.5% of the aqueous solution and, in some embodiments of the invention, preferably at least about 1% of the aqueous solution. Inclusion of one or more additional constituents which increase the solubility of the olefinic compound in the solution may permit carrying out the process with the solution containing relatively high proportions of the olefinic compound, e.g. at least about 5 or even 10% or more, but in many embodiments of the invention, the aqueous solution contains less than about 5% (e.g. not more than about 4%) of the olefinic compound and, in some of those embodiments, preferably not more than about 1.8% of the olefinic compound.

The minimum required proportion of quaternary ammonium or phosphonium cations is very small. In general, there need be only an amount sufficient to provide the desired hydrodimer selectivity (typically at least about 75%) although much higher proportions can be present if desired or convenient. In most cases, the quaternary ammonium or phosphonium cations are present in a concentration of at least about $10^{-5}$ gram mol per liter of the aqueous solution. Even more typically their concentration is at least about $10^{-4}$ gram mol per liter of the solution. Although higher proportions may be present in some cases, as aforesaid, the quaternary ammonium or phosphonium cations are generally present in the aqueous solution in a concentration not higher than about 0.5 gram mol per liter and even more usually, in a concentration not higher than about $10^{-1}$ gram mol per liter. In some preferred embodiments, the concentration of quaternary ammonium or phosphonium cations in the solution is between about $10^{-4}$ and about $10^{-2}$ gram mol per liter.

The quaternary ammonium or phosphonium cations that are present in such concentrations are those positively charged ions in which a nitrogen or phosphorous atom has a valence of five and is directly linked to other atoms (e.g. carbon) satisfying four fifths of that valence. Such cations need contain only one pentavalent nitrogen or phosphorous atom but may contain more of such pentavalent atoms, e.g. as in the multivalent multi-quaternary ammonium or phosphonium cations referred to hereinbefore. Suitable mono-quaternary ammonium or phosphonium cations may be cyclic, as in the case of the piperidiniums, pyrrolidiniums and morpholiniums, but they are more generally of the type in which a pentavalent nitrogen or phosphorous atom is directly linked to a total of four monovalent organic groups preferably devoid of olefinic unsaturation and desirably selected from the group consisting of alkyl and aryl radicals and combinations thereof. Suitable multi-quaternary ammonium or phosphonium cations may likewise be cyclic, as in the case of the piperaziniums, and they are typically of a type in which the pentavalent nitrogen or phosphorous atoms are linked to one another by at least one divalent organic (e.g. polymethylene) radical and further substituted by monovalent organic groups of the kind just mentioned sufficient in number (normally two or three) that four fifths of the valence of each such pentavalent atom is satisfied by such divalent and monovalent organic radicals. As such monovalent organic radicals, suitable aryl groups contain typically from six to 12 carbon atoms and preferably only one aromatic ring as in, for example, a phenyl or benzyl radical, and suitable alkyl groups can be straight-chain, branched or cyclic with each typically containing from one to 12 carbon atoms. Although quaternary ammonium or phosphonium cations containing a combination of such alkyl and aryl groups (e.g. benzyltriethylammonium or -phosphonium ions) can be used, many embodiments of the invention are carried out with quaternary cations having no olefinic or aromatic unsaturation. Good results are generally obtained with tetraalkylammonium or tetraalkylphosphonium ions containing at least three $C_2$–$C_6$ alkyl groups and a total of from 8 to 24 carbon atoms in the four alkyl groups, e.g. tetraethyl-, ethyltripropyl-, ethyltributyl-, ethyltriamyl-, ethyltrihexyl-, octyltriethyl-, tetrapropyl-, methyltripropyl-, decyltripropyl-, methyltributyl-, tetrabutyl-, amyltributyl-, tetraamyl-, tetrahexyl-, ethyltrihexyl-, diethyldioctylammonium or -phosphonium and many others referred to in the aforecited U.S. Pat. Nos. 3,193,475-79 and 3,193,481-83. Generally most practical from the economic standpoint are those tetraalkylammonium ions in which each alkyl group contains from two to five carbon atoms, e.g. diethyldiamyl-, tetrapropyl-, tetrabutyl-, amyltipropyl-, tetraamylammonium, etc., and those $C_8$–$C_{20}$ tetraalkylphosphoniun ions containing at least three $C_2$–$C_5$ alkyl groups, e.g. methyltributyl-, tetrapropyl-, ethyltriamyl-, octyltriethylphosphonium, etc. Particularly useful are the $C_8$–$C_{16}$ tetraalkylphosphonium ions containing at least three $C_2$–$C_4$ alkyl groups. Similarly good results are obtained by use of the divalent polymethylenebis(trialkylammonium or trialkylphosphonium) ions, particularly those containing a total of from 17 to 36 carbon atoms and in which each trialkylammonium or trialkylphosphonium radical contains at least two $C_3$–$C_6$ alkyl groups and the polymethylene radical is $C_3$–$C_8$, i.e., a straight chain of from three of eight methylene radicals. Presently most attractive from the economic standpoint are the $C_{18}$–$C_{32}$ polymethylenebis(trialkylammonium or trialkylphosphonium ions in which each trialkylammonium or trialkylphosphonium radical contains at least two $C_3$–$C_5$ alkyl groups and the polymethylene radical is $C_4$–$C_6$. In many embodiments of the invention employing such polymethylenebis(trialkylammonium) ions, the carbon atom content of such ions is preferably from 20 to 34. Presently of specific interest for potential commercial use in the process of this invention are the $C_{20}$–$C_{34}$ hexamethylenebis(trialkylammonium) ions, e.g. those in which each trialkylammonium radical contains at least two $C_3$–$C_6$ alkyl groups, partly because water-soluble salts of such cations can be relatively simply prepared from hexamethylenediamine which is readily available in commercial quantities at relatively low cost. Also generally preferred are the hexamethylenebis(trialkylammonium or trialkylphosphonium) ions containing from 20 to 30 carbon atoms, e.g. those in which each trialkylammonium or trialkylphosphonium radical contains at least two $C_3$–$C_5$ alkyl groups, and especially the $C_{24}$–$C_{30}$ hexamethylenebis(-trialkylammonium) ions in which each trialkylammonium radical contains at least one and preferably two n-butyl groups. Any of such cations can be incorporated into the aqueous solution to be electrolyzed in any convenient manner, e.g. by dissolving the hydroxide or a salt (e.g. a $C_1$–$C_2$ alkylsulfate) of the desired quaternary ammonium or phosphonium cation(s) in the solution in the amount required to provide the desired concentration of such cations.

On significant advantage of the polymethylenebis(-trialkylammonium or trialkyphosphonium) ions for use in the present invention is that relative to most of the corresponding tetraalkylammonium and tetraalkylphosphonium ions of the type described hereinbefore, they tend to distribute themselves in higher proportion toward the aqueous phase of a mixture of an aqueous solution of the type electrolyzed in accordance with the present invention and the undissolved organic phase which, as aforesaid, may be present in the aqueous solution during the electrolysis. Whether or not such an organic phase is present in substantial proportion in the aqueous solution during the electrolysis, product hydrodimer is generally most conveniently removed from the electrolyzed solution by adding to the solution (either before or after the electrolysis) an amount of the olefinic starting material in excess of its solubility therein, mixing the solution and the excess olefinic compound until they are substantially equilibrated, and then separating (e.g. decanting) from the resulting mixture a first portion thereof that is richer than said mixture in the olefinic compound and therefore richer than said mixture in the hydrodimer product with is normally substantially more soluble in the olefinic compound than in the electrolyzed aqueous solution. Normally, the hydrodimer product is separated from said first portion of the mixture (e.g. by distillation) while a second portion of the mixture comprising an aqueous solution of the type subjected to electrolysis in accordance with the present invention is recycled and the aqueous solution comprised by said second portion is subjected to more of such electrolysis. In process embodiments in which the hydrodimer product is separated from the electrolyzed solution in the manner just described and in view of the importance of having sufficient quaternary ammonium or phosphonium cations in the aqueous solution to maintain a high hydrodimer selectivity on further electrolysis of the solution, the use of a quaternary cation that distributes itself in relatively high proportion in the aqueous portion of a substantially equilibrated mixture of the type just described is highly attractive from the standpoint of lessening the costs of recovering such cations from the separated (e.g. decanted) organic portion of the mixture and/or loss of such cations due to incomplete recovery from said organic portion of the mixture. Surprisingly, and despite their generally higher carbon content, various bis-quaternary cations of the class defined hereinbefore have been found to distribute themselves toward the aqueous solution in ratios significantly higher (e.g. up to at least 3–4 times higher) than those of the corresponding mono-quaternary cations.

The alkali metal salts which can be employed in the invention are those of sodium, potassium, lithium, cesium and rubidium. Generally preferred for economic reasons are those of lithium and especially sodium and potassium. They may be salts of a monovalent acid, e.g. a perchlorate, a nitrate, an acetate or a halide such as chloride or bromide. In some cases, e.g. where corrosion control is more of a factor, it may be desirable to use an alkali metal salt of a polyvalent acid, e.g. an orthophosphate, borate, carbonate or sulfate, and particularly an incompletely-substituted salt of that type, i.e. a salt in which the anion has at least one valence thereof satisfied by hydrogen and at least one other valence thereof satisfied by an alkali metal. Examples of such salts include disodium phosphate ($Na_2HPO_4$), potassium acid phosphate ($KH_2PO_4$), sodium bicarbonate ($NaHCO_3$), dipotassium borate ($K_2HBO_3$), and sodium acid sulfate ($NaHSO_4$). Also useful are the alkali metal salts of condensed acids such as pyrophosphoric, metaphosphoric, metaboric, pyroboric and the like (e.g. sodium pyrophosphate, potassium metaborate, etc.). Depending on the acidity of the aqueous solution to be electrolyzed, the stoichiometric proportions of such anions and alkali metal cations in the solution may correspond to a mixture of two or more of such salts, e.g. a mixture of sodium acid phosphate and disodium phosphate, and accordingly, such mixtures of salts (as well as mixtures of salts of different alkali metals and/or different acids, e.g. phosphoric and boric) are intended to be within the scope of the expressions "alkali metal salt" and "sodium or potassium salt" as used herein. Any of the alkali metal salts may be dissolved in the aqueous solution as such or otherwise, e.g. as the alkali metal hydroxide and the acid necessary to neutralize the hydroxide to the extent of the desired acidity of the aqueous solution.

The concentration of alkali metal salt in the solution should be at least sufficient to substantially increase the electrical conductivity of the solution above its conductivity without such a salt being present. In general, there is also enough alkali metal salt dissolved in the solution to provide alkali metal cations constituting more than half of the total weight of all cations in the solution. In most cases, the solution has dissolved therein at least about 0.1% of the alkali metal salt. More advantageous conductivity levels are achieved when the solution has dissolved therein at least about 1% of alkali metal salt, or more preferably, at least about 2% of such a salt. In many case, optimum process conditions include the solution having dissolved therein more than 5% (typically at least 5.5%) of alkali metal salt. The maximum amount of alkali metal salt in the solution is limited only by its solubility therein, which varies with the particular salt employed. With salts such as sodium or potassium phosphates, it is generally most convenient when the solution contains between about 1 and about 15% of such a salt or mixture thereof.

The acidity of the solution is preferably such that an alkaline conditions prevails at the cathode. Since there is normally an acidity gradient across the cell, pH at the anode can be lower than seven, if desired. In most cases, however, pH of the overall solution should be at least about two, is preferably at least about five and when the solution is in contact with certain metals subject to corrosion, is most conveniently at least about seven. Also in most cases, the overall solution pH is not higher than about 12, typically not higher than about 11 and, with the use of sodium or potassium phosphates and/or borates, generally not higher than about 10.

The temperature of the solution may be at any level compatible with existence as such of the solution itself, i.e., above its freezing point but below its boiling point under the pressure employed. Good results can be achieved between about 5° and about 75°C. or even higher temperatures if pressures substantially above one atmosphere are employed. The optimum temperature range will vary with the specific olefinic compound and hydrodimer, among other factors, but in hydrodimerization of acrylonitrile to adiponitrile, an electrolysis temperature between about 25° and about 75°C. is usually preferred.

Although not necessary, a liquid-impermeable cathode is usually preferred. With the use of such a cathode, the aqueous solution to be electrolyzed is generally passed along the surface thereof at a linear velocity with reference to the adjacent cathodic surface of at least about 0.3 meter per second, preferably at least about 0.6 meter per second and even more preferably between about 0.9 and about 2.4 meters per second although, if desired, a solution velocity up to 6 meters per second or higher can be employed. The gap between the anode and cathode can be very narrow, e.g. about 1 millimeter or less, or as wide as 12.5 millimeters or even wider, but is generally of a width between about 1.5 and about 6.2 millimeters.

As is well-known, electrolytic hydrodimerization of an olefinic compound having a formula as set forth hereinbefore must be carried out in contact with a cathodic surface having a cathode potential sufficient for hydrodimerization of that compound. In general, there is no minimum current density with which the process can be carried out at such a cathodic surface but in most cases, a current density of at least about 0.01 amp per square centimeter of the cathodic surface is used and a current density of at least about 0.05 amp per square centimeter of the cathodic surface is usually preferred. Although higher current densities may be practical in some instances, those generally employed in the present process are not higher than about 1.5 amps per square centimeter and even more typically not higher than about 0.75 amp per square centimeter of the aforedescribed cathodic surface. Depending on other process variables, current densities not higher than about 0.5 amp per square centimeter may be preferred in some embodiments of the invention.

As aforesaid, the process of this invention is carried out with a cathodic surface consisting essentially of cadmium, meaning that the cathodic surface contains a very high percentage of cadmium (generally at least about 90%, more typically at least about 95% and preferably at least about 98%) but that it may contain a small amount of one or more other constituents that do not alter the nature of the cadmium cathode so as to prevent it from providing the advantages of the present invention, particularly as described herein. Such other constituents, if present, are preferably other materials having relatively high hydrogen overvoltages. When such other materials are present in a relatively high concentration such as, for example, from about 0.5 up to about 5% or higher, they are preferably lead and/or mercury. However, best results are generally obtained when the cathodic surface has a cadmium content of at least about 99.5%, even more typically at least about 99.8% and most desirably at least about 99.9% as in ASTM Designation B440-66T (issued 1966).

Cathodes employed in this invention can be prepared by any of various techniques such as, for example, electroplating of cadmium on any suitably-shaped substrate of some other material, e.g. a metal having greater structural rigidity, or by chemically, thermally and/or mechanically bonding a layer of cadmium or an alloy thereof containing one or more of the aforementioned other optionally-present cathode constituents to a similar substrate. Alternatively, a plate, sheet, rod or any other suitable configuration consisting essentially of cadmium may be used without such a substrate, if desired.

As aforesaid and contrary to expectations based on the disclosure of British Pat. No. 1,014,428, use of the process embodiments described herein including a cathodic surface consisting essentially of cadmium provides the desired hydrodimer with a high molar selectivity, based on the converted olefinic starting material, and for clearly long enough periods of time for attractive commercial practice of the process. The hydrodimer selectivity of the present invention, as contrasted with essentially zero in the British Pat. No. 1,014,428 process embodiments using a cadmium cathode, is normally at least about 75%, i.e., at least about 75% of the moles of converted olefinic starting material are converted to the desired dinitrile, dicarboxylate or dicarboxamide. In many cases, the molar selectivity of the present process is at least about 80% and, in some instances including certain embodiments employed in hydrodimerization of acrylonitrile to adiponitrile, as high as 85% or even higher.

The process of this invention can be satisfactorily carried out in a divided cell having a cation-permeable membrane, diaphragm or the like separating the anode and cathode compartments of the cell in such a way that the aqueous solution undergoing electrolysis is not in contact with the anode of the cell and products of anode corrosion, if any, are substantially prevented from migrating to the cathode of the cell. The process can also be carried out in a cell not divided in that manner, i.e., in an electrolytic cell in which the aforedescribed aqueous solution is simultaneously in direct physical contact with an anode and cathode of the cell, and in which the anode is composed of a material not corroded by the solution at a substantial rate (e.g. at least about $10^{-3}$ inch per year) such as, for example, one of the materials conventionally regarded as corrosionproof (e.g. platinum, various alloys of platinum, other precious metals and alloys thereof, lead dioxide, etc.). In both of such embodiments, anode corrosion products normally do not reach the cathode of the cell in a quantity large enough to plate out on or foul the cathode to a degree sufficient to greatly lower the hydrodimer selectivity of the process and it has been found that the surface smoothness of the cathode is generally not of critical importance to long-term maintenance of high selectivities when that is the case.

In another embodiment, the process of this invention can be carried out in an undivided cell in which the anode is in contact with the aqueous solution, as aforesaid, and the anode is composed of a material which, depending on process conditions such as the particular alkali metal salt employed, the solution temperature, etc., may or may not be corroded by the solution at a substantial rate under the electrolysis conditions. Such less corrosion-resistant anode materials include the ferrous metals such as iron and steel, magnetite, nickel, and, in fact, any metal or alloy capable of being passivated, particularly is the slution undergoing electrolysis is alkaline or at least not strongly acidic (i.e., pH not substantially below seven). When the process is carried out with an anode comprising such a less corrosion-resistant material in contact with the solution undergoing electrolysis and the anode is substantially corroded under the conditions of the process, e.g. such that products of corrosion of the anode become dispersed in the electrolysis medium and subsequently tend to plate out on and/or foul the cathodic surface to a degree which would otherwise substantially lower the hydrodimerization selectivity, it is generally most advantageous for long-term maintenance of high hydrodimer selectivities to inhibit such plating out and/or fouling by employing a cathodic surface having a degree of smoothness corresponding to a centerline average not greater than about 90 microinches (2.29 microns) as determined in accordance with the definition of centerline average set forth in American Standard ASA B46.1-1962 (Surface Texture) published by The American Society of Mechanical Engineers, 345 East 47th Street, New York, New York. In most cases, the centerline average of the cathodic surface employed in this embodiment of the present process is desirably less than about 70 microinches (1.78 microns), preferably less than about 50 microinches (1.27 microns) and, for superior results in many cases, less than about 30 microinches (0.76 micron), all determined in accordance with the definition in the aforecited ASA publication. Centerline average, as the term is used herein, can be measured by various procedures and types of apparatus, exemplary of which are the Tank Taylor Hobson Talysurf 4 and the procedures described in the Talysurf 4 Operator's Handbook distributed by Rank Precision Industries Ltd., Metrology Division, P.O. Box 36, Leicester House, Lee Circle, Leicester LE1 9JB, England and in the U.S.A. by Engis Equipment Company, 8035 Austin Avenue, Morton Grove, Illinois 60053. In some embodiments in which anode corrosion may otherwise proceed at a relatively high rate, it may be desirable to also include in the electrolysis medium a small amount (generally between about 0.02 and about 3%) of an inhibitor of corrosion of the anode material employed (e.g. an alkali metal salt of a boric or condensed phosphoric acid when the anode material comprises a ferrous metal) and/or a similarly small amount of a chelating agent for the anode metal (e.g. an alkali metal salt of a nitrilocarboxylic acid, such as tetrasodium ethylenediaminetetracetate or -propionate, trisodium hydroxyethylethylenediaminetriacetate, trisodium nitrilotriacetate or the like).

The following specific examples of the process of this invention are included for purposes of illustration only and do not imply any limitations on the scope of the invention. Also in the following examples, acrylonitrile and adiponitrile are generally represented by AN and ADN, respectively.

EXAMPLE I

In a continuous process, an aqueous solution having dissolved therein approximately 1.6% AN, 1.2% ADN, 0.2% AN EHD byproducts, $5.8 \times 10^{-3}$ gram mol per liter of ethyltributylammonium cations, 10% of a mixture of incompletely-substituted sodium orthophosphates corresponding to the solution pH of 9, 0.1% of a ferrous metal corrosion inhibitor (tetrasodium pyrophosphate) and about 0.05% of tetrasodium ethylenediaminetetracetate was circulated at 55°C. and velocity between 1.22 and 1.37 meters per second through an undivided electrolytic cell having a carbon steel anode separated by a gap of 2.72 millimeters from a cathodic surface composed of a rolled sheet of cadmium conforming at ASTM Designation B440-66T issued 1966 (at least 99.9% Cd) and having a centerline average of about 10 microinches (0.25 micron) measured in accordance with the definition set forth in American Standard ASA B46. 1-1962. The solution, which also had entrained therein approximately 1% by weight of an organic phase containing about 54% ADN, 29% AN, 9% AN EHD byproducts and 8% water, was electrolyzed as it passed through the cell with a voltage drop across the cell of 4.7 volts and a current density of 0.27 amp per square centimeter of cathodic surface and then fed into a decanter for equilibration with an accumulated upper layer having approximately the composition of the aforedescribed organic phase and withdrawal of equilibrated lower (aqueous) layer for recycle through the cell. After 776 hours of electrolysis during which AN and water were continuously added to the circulating aqueous solution and an equivalent amount of the organic phase containing product ADN, byproducts and unreacted AN was removed, it was found that AN in the solution had been converted to ADN with an average selectivity of 86.1% and the cathodic surface had corroded at the average rate of only 0.076 millimeter per year.

EXAMPLE II

In a continuous process, an aqueous solution having dissolved therein approximately 1.6% AN, 1.2% ADN, 0.2% AN EHD byproducts, ethyltributylammonium cations in a concentration varying between 9 and $25 \times 10^{-3}$ gram mol per liter. 9% of a mixture of incompletely-substituted sodium orthophosphates corresponding to the solution pH of 9, 0.1% of a ferrous metal corrosion inhibitor (tetrasodium pyrophosphate) and about 0.05% of tetrasodium ethylenediaminetetraacetate was circulated at a temperature between 50° and 55°C. and a velocity between 0.914 and 1.22 meters per second through an undivided electrolytic cell having a carbon steel anode separated by a gap of 3.18 millimeters from a cathodic surface composed of a rolled sheet of cadmium essentially the same in composition and centerline average as that employed in Example I. The solution, which also had entrained therein approximately 4% by weight of an organic phase containing about 54% ADN, 29% AN, 9% AN EHD byproducts and 8% water, was electrolyzed as it passed through the cell with a voltage drop across the cell of 4.5 volts and a current density of 0.23 amp per square centimeter of cathodic surface and then fed into a decanter for equilibration with an accumulated upper layer having approximately the composition of the aforedescribed organic phase and then withdrawal of equilibrated lower (aqueous) layer for recycle through the cell. After 325 hours of electrolysis during which AN and water were continuously added to the circulating aqueous solution and an equivalent amount of the organic phase containing product ADN, byproducts and unreacted AN was removed, it was found that AN in the solution had been converted to ADN with an average selectivity of 86.1% and the cathodic surface had corroded at the average rate of only 0.051 millimeter per year.

EXAMPLE III

In a continuous process, an aqueous solution having dissolved therein approximately 0.8% AN, 1.1% ADN, 0.15% AN EHD byproducts, $8 \times 10^{-3}$ gram mol per liter of tetrabutylammonium cations, 13% of a mixture of incompletely-substituted sodium orthophosphates corresponding to the solution pH of 8 and 0.05–0.1% of a ferrous metal corrosion inhibitor (tetrasodium pyrophosphate) was circulated at 50°C. and a velocity of 1.22 meters per second through an undivided electrolytic cell having a carbon steel anode separated by a gap of 2.39 millimeters from a cathodic surface composed of a rolled sheet of cadmium essentially the same in composition and centerline average as that employed in Examples I and II. The solution, which also had entrained therein approximately 4% by weight of an organic phase containing about 64% ADN, 17% AN, 11% AN EHD byproducts and 8% water, was electrolyzed as it passed through the cell with a voltage drop across the cell of 4.35 volts and a current density of 0.25 amp per square centimeter of cathodic surface and then fed into a decanter for equilibration with an accumulated upper layer having approximately the composition of the aforedescribed organic phase and then withdrawal of equilibrated lower (aqueous) layer for recycle through the cell. After 28 hours of electrolysis during which AN and water were continuously added to the circulating aqueous solution and an equivalent amount of the organic phase containing product ADN, byproducts and unreacted AN was removed, it was found that AN in the solution had been converted to ADN with an average selectivity of 85.8% and corrosion of the cathodic surface had been negligible, i.e., less than 0.025 millimeter per year.

EXAMPLE IV

In a continuous process, a lilquid electrolysis medium composed between 85.9% and 87.5% by (1) an aqueous solution having dissolved therein between 1.4% and 1.6% AN, about 1.2% ADN, 9.6-9.9% of a mixture of sodium orthophosphates, 0.8–2.5 × $10^{-3}$ mole per liter of ethyltributylammonium ions and the sodium borates produced by neutralizing orthoboric acid in an amount corresponding to about 2% of the solution to the solution pH of 8.5–9 and between 12.5% and 14.1% by (2) a dispersed but undissolved organic phase containing 26–29% AN, 54–59% ADN, 7–9% AN dimerization byproducts and 8% water was circulated at 55°C. and 1.16 meters per second through an undivided electrolytic cell having an AISI 1020 carbon steel anode separated by a gap of 2.25 millimeters from a cathode composed of cadmium conforming to ASTM Designation B440-66T (at least 99.9% Cd) and having a center-line average of 10-15 microinches (0.25–0.38 micron) measured according to American Standard ASA B46. 1-1962 and electrolyzed as if passed through the cell with a current density of 0.2 amp per square centimeter of the surface of the cathode. Organic phase containing product ADN, byproducts and unreacted AN was separated from the electrolyzed medium and make-up AN was added after which the medium was recirculated through the cell and electrolyzed again under the conditions just described. For each Faraday of current passed through the medium, 0.475 millimole of tetrasodium ethylenediaminetetraacetate ($Na_4EDTA$) was added to the circulating medium and about 10 grams of the solution were purged from the system and replaced with water containing sufficient dissolved ethyltributylammonium ions and sodium orthophosphates and borates to maintain the concentrations of those constituents of the solution at the aforedescribed levels and the total volume of the medium essentially constant. After 268 hours of electrolysis under those conditions, it was found that AN had been converted to ADN with average and final selectivities of 87–88% and the cathodic surface had corroded at the average rate of only 0.127 millimeter per year.

EXAMPLE V

In a continuous process, a liquid electrolysis medium composed about 99% by (1) an aqueous solution having dissolved therein between 1.4% and 1.6% AN, about 1.2% ADN, 10% of a mixture of sodium orthophosphates, 0.6–1.4 × $10^{-3}$ mole per liter of methyltributylphosphonium ions and the sodium borates produced by neutralizing orthoboric acid in an amount corresponding to about 2% of the solution to the solution pH of about 8.5 and about 1% by (2) a dispersed but undissolved organic phase containing 27–29% AN, 54–58% ADN, 7–9% AN dimerization byproducts and 8% water was circulated at 55°C. and 1.22 meters per second through an undivided electrolytic cell having an AISI 1020 carbon steel anode separated by a gap of 1.76 millimeters from a cadmium cathode essentially the same as that used in Example IV and electrolyzed as it passed through the cell with a current density of 0.185 amp per square centimeter of the surface of the cathode. Organic phase containing product ADN, byproducts and unreacted AN was separated from the electrolyzed medium and makeup AN was added after which the medium was recirculated through the cell and electrolyzed again under the conditions just described. For each Faraday of current passed through the medium, 0.4 millimole of $Na_4EDTA$ was added to the circulating medium and about 12 grams of the solution were purged from the system and replaced with water containing sufficient dissolved methyltributylphosphonium ions and sodium orthophosphates and borates to maintain the concentrations of those constituents of the solution at the aforedescribed levels and the total volume of the medium essentially constant. After 120 hours of electrolysis under those conditions, it was found that AN had been converted to ADN with average and final selectivities of 88% and the cathodic surface had corroded at an average rate less than 0.1 millimeter per year.

EXAMPLE VI

In a continuous process, a liquid electrolysis medium composed about 99% by (1) an aqueous solution having dissolved therein between 1.6% and 1.9% AN, about 1.2% ADN, 10% of a mixture of sodium orthophosphates, 0.8–5.2 × $10^{-3}$ mole per liter of tetramethylenebis(tributylammonium) ions and the sodium borates produced by neutralizing orthoboric acid in an amount corresponding to about 2% of the solution to the solution pH of about 8.5 and about 1% by (2) a dispersed but undissolved organic phase containing 29–34% AN, 50–56% ADN, 7–8% AN dimerization byproducts and 8% water was circulated at 55°C. and 1.22 meters per second through an undivided electrolytic cell having an AISI 1020 carbon steel anode separated by a gap of 1.76 millimeters from a cadmium cathode essentially the same as in Example IV and electrolyzed as it passed through the cell with a current density of 0.185 amp per square centimeter of the surface of the cathode. A portion of the organic phase of the electrolyzed medium containing product ADN, byproducts and unreacted AN was separated by decantation and make-up AN was added to the undecanted portion of the medium which was then recirculated through the cell and electrolyzed again under the conditions just described. For each Faraday of current passed through the medium, 0.4 millimole of $Na_4EDTA$ was added to the circulating medium and about 12 grams of the solution were purged from the system and replaced with water containing sufficient dissolved tetramethylenebis(tributylammonium) ions and sodium orthophosphates and borates to maintain the concentrations of those constituents of the solution at the aforedescribed levels and the total volume of the medium essentially constant. After 171 hours of electrolysis under those conditions, it was found that AN had been converted to ADN with average and final selectivities of 87–88% and the cathodic surface had corroded at an average rate slower than 0.1 millimeter per year. In addition, it was found that the distribution coefficient of the tetramethylenebis(tributylammonium) ions representing the ratio of the concentrations of such ions in the aqueous and organic phases of the electrolyzed medium was normally no higher than 3–4 (organic phase concentration divided by aqueous phase concentration) whereas the corresponding distribution coefficient of the most similar mono-quaternary ammonium ion (the ethyltributylammonium ion) in an otherwise-similar electrolysis medium is normally between 10 and 15.

EXAMPLE VII

In a continuous process, a liquid electrolysis medium composed about 99% by (1) an aqueous solution having dissolved therein between 1.5% and 1.7% AN, about 1.2% ADN, about 10% of a mixture of sodium orthophosphates, 1.5–15.8 $\times 10^{-3}$ mole per liter of hexamethylenebis(ethyldibutylammonium) ions and the sodium borates produced by neutralizing orthoboric acid in an amount corresponding to about 2% of the solution to the solution pH of about 8.5 and about 1% by (2) a dispersed but undissolved organic phase containing 28–31% AN, 54–57% ADN, about 7% AN dimerization byproducts and 8% water was circulated at 55°C. and 1.22 meters per second through an undivided electrolytic cell having an AISI 1020 carbon steel anode separated by a gap of 1.76 millimeters from a cadmium cathode essentially the same as that used in Example IV and electrolyzed as it passed through the cell with a current density of 0.185 amp per square centimeter of the surface of the cathode. A portion of the organic phase of the electrolyzed medium containing product ADN, byproducts and unreacted AN was separated by decantation and make-up AN was added to the undecanted portion of the medium which was then recirculated through the cell and electrolyzed again under the conditions just described. For each Faraday of current passed through the medium, 0.4 millimole of $Na_4EDTA$ was added to the circulating medium and about 12 grams of the solution were purged from the system and replaced with water containing sufficient dissolved hexamethylenebis(ethyldibutylammonium) ions and sodium orthophosphates and borates to maintain the concentrations of those constituents of the solution at the aforedescribed levels and the total volume of the medium essentially constant. After 168 hours of electrolysis under those conditions, it was found that AN had been converted to ADN with average and final selectivities of 88–89% and the cathodic surface had corroded at an average rate slower than 0.1 millimeter per year. In addition, it was found that the distribution coefficient of the hexamethylenebis(ethyldibutylammonium) ions, as that coefficient is defined in Example VI, was normally no higher than 2–4.

We claim:

1. A process for hydrodimerizing an olefinic compound having the formula $R_2C{=}CR{-}X$ wherein $-X$ is $-CN$, $-CONR_2$ or $-COOR'$, R is hydrogen or R', R' is $C_1$–$C_4$ alkyl and at least one R directly attached to either of the two carbon atoms joined by the double bond in said formula is hydrogen which comprises electrolyzing an aqueous solution having dissolved therein at least about 0.5% but less than about 5% by weight of said olefinic compound, at least about 1% by weight of sodium or potassium salt selected from the group consisting of phosphate, borate, perchlorate, carbonate and sulfate sufficient to provide sodium or potassium ions constituting more than half of the total weight of all cations in the solution and from about $10^{-5}$ to about 0.5 gram mol per liter of $C_{17}$–$C_{36}$ polymethylenebis(trialkylammonium) ions in which each trialkylammonium radical contains at least two $C_3$–$C_6$ alkyl groups and the polymethylene radical is $C_3$–$C_8$ in contact with a cathodic surface having a cathode potential sufficient for hydrodimerization of said olefinic compound and consisting essentially of cadmium with a current density between about 0.01 and about 1.5 amps per square centimeter of said cathodic surface and at a temperature between about 5° and about 75°C.

2. The process of claim 1, said solution having dissolved therein more than 5% by weight of the sodium or potassium salt.

3. The process of claim 1 wherein the olefinic compound is acrylonitrile, said solution having dissolved therein at least about $10^{-4}$ gram mol per liter of $C_{18}$–$C_{32}$ polymethylenebis(trialkylammonium) ions in which each trialkylammonium radical contains at least two $C_3$–$C_5$ alkyl groups and the polymethylene radical is $C_4$–$C_6$.

4. The process of claim 3 which further comprises mixing said solution with acrylonitrile in excess of its solubility in said solution until said solution and said excess acrylonitrile are substantially equilibrated, separating from the mixture a first portion richer than said mixture in acrylonitrile and a second portion comprising an aqueous solution having dissolved therein at least about 0.5 but less than 5% by weight of acrylonitrile, at least about 1% by weight of said sodium or potassium salt and between about $10^{-4}$ and about 0.5 gram mol per liter of said $C_{18}$–$C_{32}$ polymethylenebis(trialkylammonium) ions, and subjecting the aqueous solution comprised by said second portion to more of said electrolyzing.

5. The process of claim 3, said solution having dissolved therein between about $10^{-4}$ and $10^{-2}$ gram mol per liter of $C_{24}$–$C_{30}$ hexamethylenebis(trialkylammonium) ions in which each trialkylammonium radical contains at least one butyl group.

6. The process of claim 1 wherein the olefinic compound is acrylonitrile and the solution is electrolyzed with a current density between about 0.05 and about 0.75 amp per square centimeter of said cathodic surface while passing the solution along said cathodic surface at a velocity of at least about 0.3 meter per second, said solution having a pH between about 5 and about 11 and a temperature between about 20° and about 75°C. and said solution having dissolved therein from about 0.5 to about 4% by weight of acrylonitrile and from about 1% to about 15% by weight of the sodium or potassium salt.

7. The process of claim 6, said solution having dissolved therein between about $10^{-4}$ and about $10^{-2}$ gram mol per liter of $C_{20}$–$C_{34}$ hexamethylenebis(trialkylammonium) ions in which each trialkylammonium radical contains at least two $C_3$–$C_6$ alkyl groups.

8. The process of claim 6, said solution having dissolved therein more than 5% by weight of the sodium or potassium salt.

9. The process of claim 8, said solution having dissolved therein not more than about 1.8% by weight of acrylonitrile.

10. The process of claim 1, wherein the solution has dispersed therein an undissolved organic phase in a proportion up to about 20% of the combined weight of the solution and said organic phase.

11. A process for hydrodimerizing an olefinic compound having the formula $R_2C{=}CR{-}X$ wherein —X is —CN, —$CONR_2$ or —COOR′, R is hydrogen or R′, R′ is $C_1$–$C_4$ alkyl and at least one R directly attached to either of the two carbon atoms joined by the double bond in said formula is hydrogen which comprises electrolyzing an aqueous solution having dissolved therein at least about 0.5 but less than about 5% by weight of said olefinic compound, at least about 1% by weight of sodium or potassium salt selected from the group consisting of phosphate, borate, perchlorate, carbonate and sulfate sufficient to provide sodium or potassium ions constituting more than half of the total weight of all cations in the solution and from about $10^{-5}$ to about 0.5 gram mol per liter of cations selected from the group consisting of $C_8$–$C_{20}$ tetraalkylphosphonium ions containing at least three $C_2$–$C_5$ alkyl groups and $C_{17}$–$C_{36}$ polymethylenebis(trialkylphosphonium) ions in which each trialkylphosphonium radical contains at least two $C_3$–$C_8$ alkyl groups and the polymethylene radical is $C_3$–$C_8$ in contact with a cathodic surface having a cathode potential sufficient for hydrodimerization of said olefinic compound and consisting essentially of cadmium with a current density between about 0.01 and about 1.5 amps per square centimeter of said cathodic surface and at a temperature between about 5° and about 75°C.

12. The process of claim 11 wherein the olefinic compound is acrylonitrile, said solution having dissolved therein at least about $10^{-4}$ gram mol per liter of $C_8$–$C_{16}$ tetraalkylphosphonium ions containing at least three $C_2$–$C_4$ alkyl groups.

13. The process of claim 11, said solution having dissolved therein more than 5% by weight of the sodium or potassium salt.

14. The process of claim 11, wherein the olefinic compound is acrylonitrile, said solution having dissolved therein at least about $10^{-4}$ gram mol per liter of $C_{18}$–$C_{32}$ polymethylenebis(trialkylphosphonium) ions in which each trialkylphosphonium radical contains at least two $C_3$–$C_5$ alkyl groups and the polymethylene radical is $C_4$–$C_6$.

15. The process of claim 14 which further comprises mixing said solution with acrylonitrile in excess of its solubility in said solution until said solution and said excess acrylonitrile are substantially equilibrated, separating from the mixture a first portion richer than said mixture in acrylonitrile and a second portion comprising an aqueous solution having dissolved therein at least about 0.5 but less than 5% by weight of acrylonitrile, at least about 1% by weight of said sodium or potassium salt and between about $10^{-4}$ and about 0.5 gram mol per liter of said $C_{18}$–$C_{32}$ polymethylenebis(trialkylphosphonium) ions, and subjecting the aqueous solution comprised by said second portion to more of said electrolyzing.

* * * * *